US007695310B1

(12) United States Patent
Boyer et al.

(10) Patent No.: US 7,695,310 B1
(45) Date of Patent: Apr. 13, 2010

(54) SMART OUTLET WITH VALID PLUG DETECTION AND ACTIVATION

(75) Inventors: John W. Boyer, Portland, OR (US); John O. George, III, North Plains, OR (US); Roger A. Mach, Beaverton, OR (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 12/409,036

(22) Filed: Mar. 23, 2009

(51) Int. Cl.
*H01R 3/00* (2006.01)

(52) U.S. Cl. ..... 439/489; 439/188

(58) Field of Classification Search ..... 439/188, 439/488, 489, 490; 200/51.09
See application file for complete search history.

(56) References Cited

U.S. PATENT DOCUMENTS 4,616,285 A 10/1986 Sackett
6,848,923 B2 * 2/2005 Takada et al. ..... 439/188
7,121,873 B2 * 10/2006 Wu et al. ..... 439/489

* cited by examiner

*Primary Examiner*—Khiem Nguyen
(74) *Attorney, Agent, or Firm*—Lieberman & Brandsdorfer, LLC

(57) ABSTRACT

A method and apparatus for modifying a conventional electrical outlet to provide safety and security for emission of electric current from the outlet. The modified outlet include one or more localized elements for authenticating receipt of two or more valid connectors, and for limiting delivery of power to the connectors in response to the authentication.

20 Claims, 9 Drawing Sheets

SMART OUTLET WITH VALID PLUG DETECTION AND ACTIVATION

BACKGROUND OF THE INVENTION

1. Technical Field

This invention relates to an electrical outlet for delivery of electrical power to an electrical appliance. More specifically, the invention relates to granular control of the outlet with respect to delivery of electrical power.

2. Description of the Prior Art

It is recognized that electrical outlets are provided in communication with a source of electrical energy as a means of providing electrical power to electrical devices. More specifically, a conventional electrical outlet is a fitting that is connected to a power source and equipped to receive an insert. The standard electrical outlet utilized in the United States is provided with a pair of female electrical sockets that are sized to receive a corresponding set of male electrical connectors. A third socket is commonly provided for the purpose of grounding, but may not be utilized by all electrical devices. The male electrical connectors are a set of blades or prongs that mechanically and electrically connect with the female electrical sockets. In general, the electrical outlet is part of an electrical circuit. Upon receipt of the male connector by the female socket, electrical energy is delivered to a device in communication with the outlet if the electrical circuit is closed. Conversely, if the electrical circuit is open, no electrical energy is delivered to the device. Accordingly, the determination of delivery of electrical energy is at the circuit level and not dependent upon an operating status of the outlet itself.

It is recognized in the art that as long as the circuit associated with an electrical outlet is closed, the outlet can provide an electric current to a device connected to the outlet. Insertion of a plug of an electrical appliance into the outlet will result in delivery of power to the device. However, it is not safe or desirable to maintain electrical outlet in a closed and active state at all times. For example, it is known that children can be harmed by inserting objects into the electrical sockets of an electrical outlet. To mitigate the danger associated with the outlet, different forms of covers and child safety apparatus are provided. A residual current device, also known as a ground fault circuit interrupter (GFCI), is known in the art for controlling delivery of electricity to an outlet. The residual current device disconnects a circuit whenever it is determined that the electric current is not in balance. However, aside from a circuit controller and the GFCI, none of the mitigating safety apparatus address delivery of electrical energy to the outlet itself.

One prior art patent, U.S. Pat. No. 4,616,285 to Sackett, addresses safety aspects of an electrical outlet. More specifically, Sackett '285 provides a key to turn the power of the outlet to an on position or an off position. The key is inserted into each individual outlet to provide power to the outlet, or to remove power from the outlet. However, the Sackett '285 patent is limited to employment of the key to regulate power to individual outlets. The key must be inserted into the individual outlet to either remove electric current from the outlet or provide electric current to the outlet. Accordingly, the prior art of Sackett '285 is limited to insertion of a key into each outlet that require the delivery of electric current.

Therefore, there is a need to employ an apparatus and method for regulating delivery of power to an electrical outlet that overcomes the shortcomings of the prior art. More specifically, the solution should address modifying the state of delivery of power to an individual electrical outlet that does not require insertion of a key into each outlet.

SUMMARY OF THE INVENTION

This invention comprises an apparatus and method for activating an electrical outlet responsive to authentication of at least two connectors of a plug into at least two respective sockets of the outlet.

In one aspect of the invention, a method is provided for controlling delivery of electrical power to a multi-mode electrical outlet. The electrical outlet is provided in communication with a power source, and includes at least two sockets. A first contact is provided with the first outlet socket, and a second contact is provided with a second outlet socket. At least two connectors of an electrical appliance are inserted into the outlet, with a first connector inserted into the first socket of the outlet and a second connector inserted into the second socket of the outlet. A time detection element is employed for authenticating insertion of each of the two connectors into each separate socket by the respective outlet contact within a set timing threshold. The electrical outlet is activated in response to completion of the circuit within the defined timing threshold.

In another aspect of the invention, a computer system is provided with an apparatus in the form of an electrical outlet in communication with a power source. The outlet is provided with a first contact associated with a first outlet socket and a second contact associated with a second outlet socket. At least two connectors of an electrical appliance are configured to be received by the outlet. A first connector of the appliance is configured to be inserted into the first socket of the outlet, and a second connector of the appliance is configured to be inserted into the second socket of the outlet. In addition, a time detection element is provided with the apparatus to authenticate insertion of each of the two connectors into each of the separate sockets by the respective outlet contact within a defined time threshold. The electrical outlet is activated in response to completion of the circuit within the defined time threshold.

In yet another aspect of the invention, an electrical outlet is provided with a first contact associated with a first outlet socket and a second contact associated with a second outlet socket. At least two connectors of an electrical appliance are configured to be received by the outlet, including a first connector adapted to be inserted into the first socket of the outlet and a second connector adapted to be inserted into the second socket of the outlet. In addition, a timer is provided in communication with each of the sockets. The time functions to authenticate insertion of each of the two connectors into each of the separate sockets by the respective outlet contacts within a defined timing threshold. The electrical outlet is activated in response to completion of the circuit within the defined timing threshold. In addition, a control mechanism is provided in communication with the outlet to modify a state of operation of the outlet.

Other features and advantages of this invention will become apparent from the following detailed description of the presently preferred embodiment of the invention, taken in conjunction with the accompanying drawings.

BRIEF DESCRIPTION OF THE DRAWINGS

The drawings referenced herein form a part of the specification. Features shown in the drawing are meant as illustrative of only some embodiments of the invention, and not of all embodiments of the invention unless otherwise explicitly indicated. Implications to the contrary are otherwise not to be made.

DESCRIPTION OF THE PREFERRED EMBODIMENT

Figure 1:
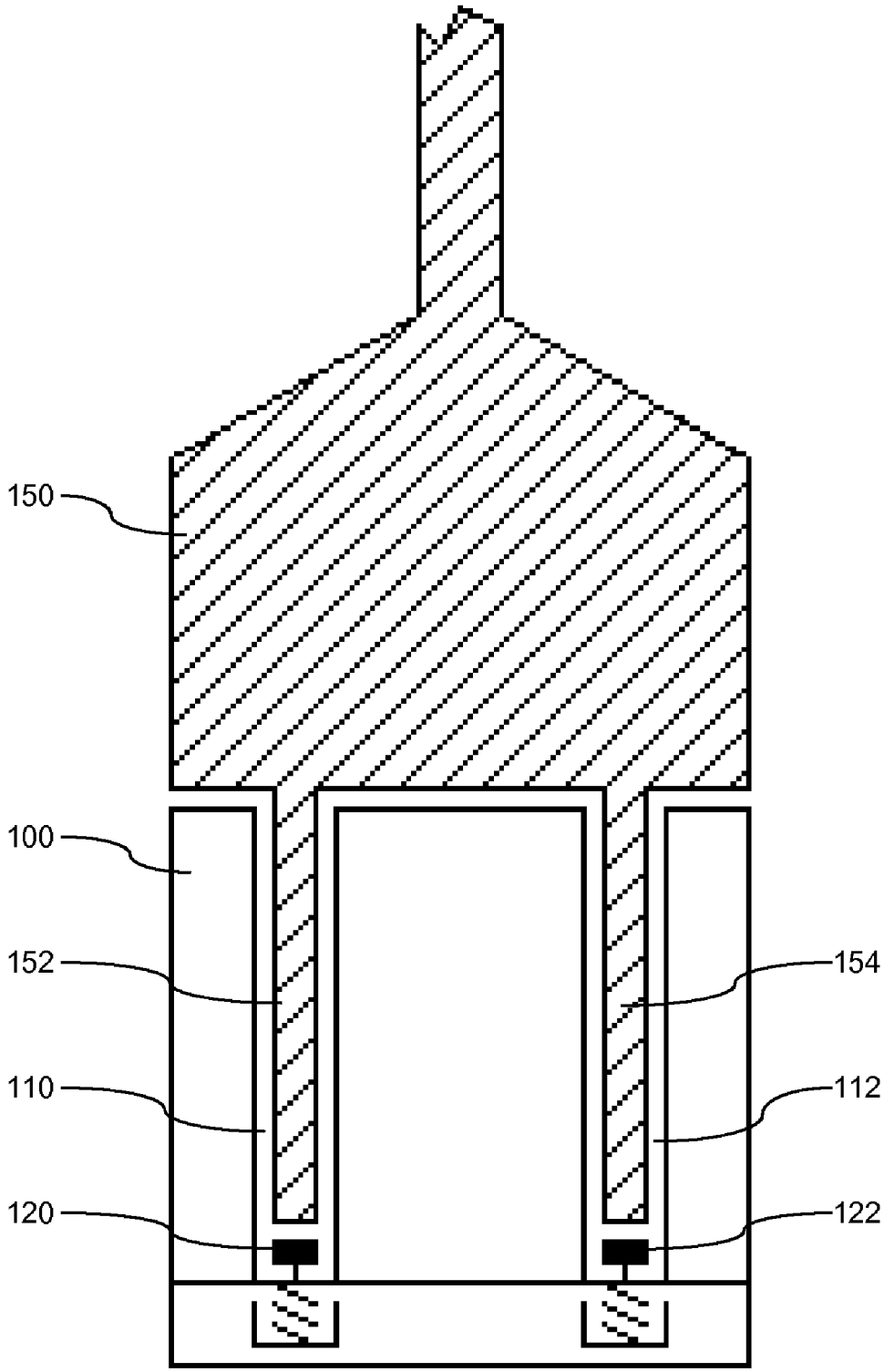
FIG. 1 is a block diagram of a modified electrical outlet with a set of contact members.

It will be readily understood that the components of the present invention, as generally described and illustrated in the Figures herein, may be arranged and designed in a wide variety of different configurations. Thus, the following detailed description of the embodiments of the apparatus, system, and method of the present invention, as presented in the Figures, is not intended to limit the scope of the invention, as claimed, but is merely representative of selected embodiments of the invention.

Reference throughout this specification to "a select embodiment," "one embodiment," or "an embodiment" means that a particular feature, structure, or characteristic described in connection with the embodiment is included in at least one embodiment of the present invention. Thus, appearances of the phrases "a select embodiment," "in one embodiment," or "in an embodiment" in various places throughout this specification are not necessarily referring to the same embodiment.

Furthermore, the described features, structures, or characteristics may be combined in any suitable manner in one or more embodiments. In the following description, numerous specific details are provided, such as examples of recovery manager, authentication module, etc., to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

The illustrated embodiments of the invention will be best understood by reference to the drawings, wherein like parts are designated by like numerals throughout. The following description is intended only by way of example, and simply illustrates certain selected embodiments of devices, systems, and processes that are consistent with the invention as claimed herein.

Overview

A configurable electrical outlet is provided with an authentication element for validating receipt of a plug into the outlet sockets. In response to the authentication, power is delivered to the outlet, and to the connectors received by the sockets of the outlet. The electrical outlet includes different states of operation, and a control mechanism for changing the state of the outlet. Each of the different states has different operating characteristics, with some of the states having more stringent operating conditions than other states. Accordingly, the configurable outlet controls delivery of power to a plug received by the sockets of the outlet.

Technical Details

In the following description of the embodiments, reference is made to the accompanying drawings that form a part hereof, and which shows by way of illustration the specific embodiment in which the invention may be practiced. It is to be understood that other embodiments may be utilized because structural changes may be made without departing from the spirit and scope of the present invention.

FIG. 1 is an electrical outlet (100) that is modified to control delivery of electrical power. As shown, the outlet (100) is provided with two female sockets (110) and (112) hereinafter referred to as sockets. Each of the sockets (110) and (112) are shown to be arranged in parallel. However, the invention should not be limited to the geometric arrangement of the sockets, as different electrical outlets may provide the openings in different arrangements. Each of the sockets (110) and (112) is provided with a respective contact member (120) and (122). The contact members serve as one element for detecting insertion of an electrical apparatus into the outlet. As shown herein, a plug (150) is inserted into the outlet (100). More specifically, male connectors (152) and (154), hereinafter referred to as connectors or prongs, are inserted into sockets (110) and (112), respectively. In one embodiment, the contacts (120) and (122) function to close a circuit to deliver electrical current to the inserted plug (150). When the contact members (120) and (122) are both depressed, the circuit (not shown) is closed, and power is delivered to the plug (150). Both contact members (120) and (122) have to be depressed in order to close the circuit. Accordingly, in one embodiment, the safety aspect of the outlet requires contact of both connectors (152) and (154) with both of the respective contact members (120) and (122).

Figure 2:
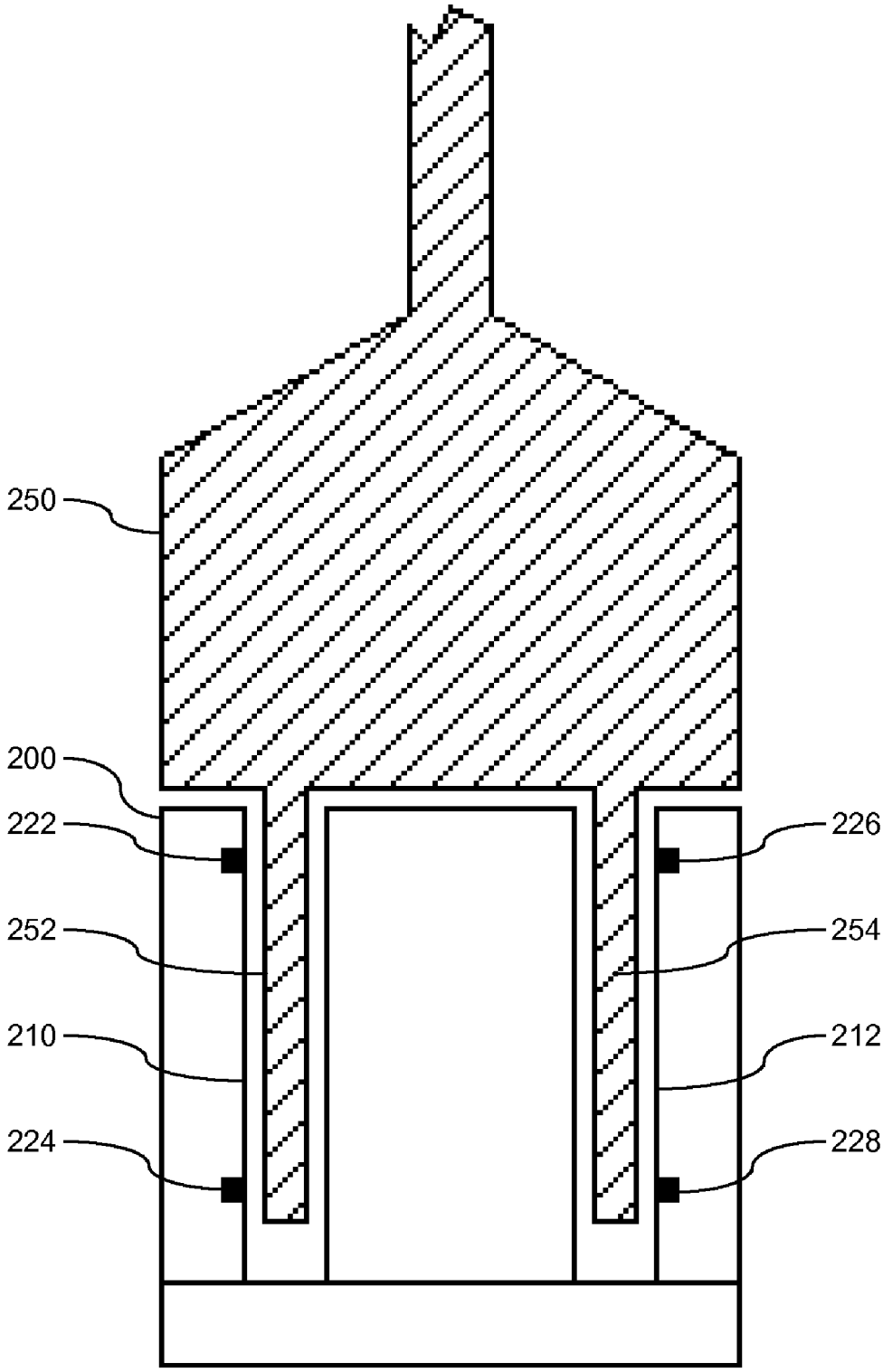
FIG. 2 is a block diagram of a modified electrical outlet with a modified arrangement of the set of contact members.

Similarly, in one embodiment, the contact members may be arranged along the length of the sockets (110) and (112). FIG. 2 is a diagram (200) showing an alternative arrangement of the contact members in the outlet. More specifically, the outlet (200) is shown with two sockets (210) and (212), with each of the sockets having a set of contact members. Socket (210) has contact members (222) and (224), and socket (212) has contact members (226) and (228). A plug (250) is received by the outlet (200). More specifically, the plug (250) is provided with two connectors (252) and (254). Connector (252) is received by socket (210), and connector (254) is received by socket (212). As each of the connectors (252) and (254) are inserted into the respective sockets (210) and (212), their presence is received by the respective contact members. More specifically, insertion of connector (252) is detected by contact members (222) and (224), and insertion of connector (254) is detected by contact members (226) and (228). Upon each of the contact members (222)-(228) sensing presence of the respective connectors, the circuit is completed. In one embodiment, if the detection is limited to the first contacts (222) and (226), and not by the second contacts (224) and (228), the circuit is not completed. Accordingly, in the embodiment shown herein, one or both sets of contact members (222), (224) and (226), (228) must be activated in order to complete the circuit to deliver power to the plug (250) in communication with the outlet (200).

Figure 3:
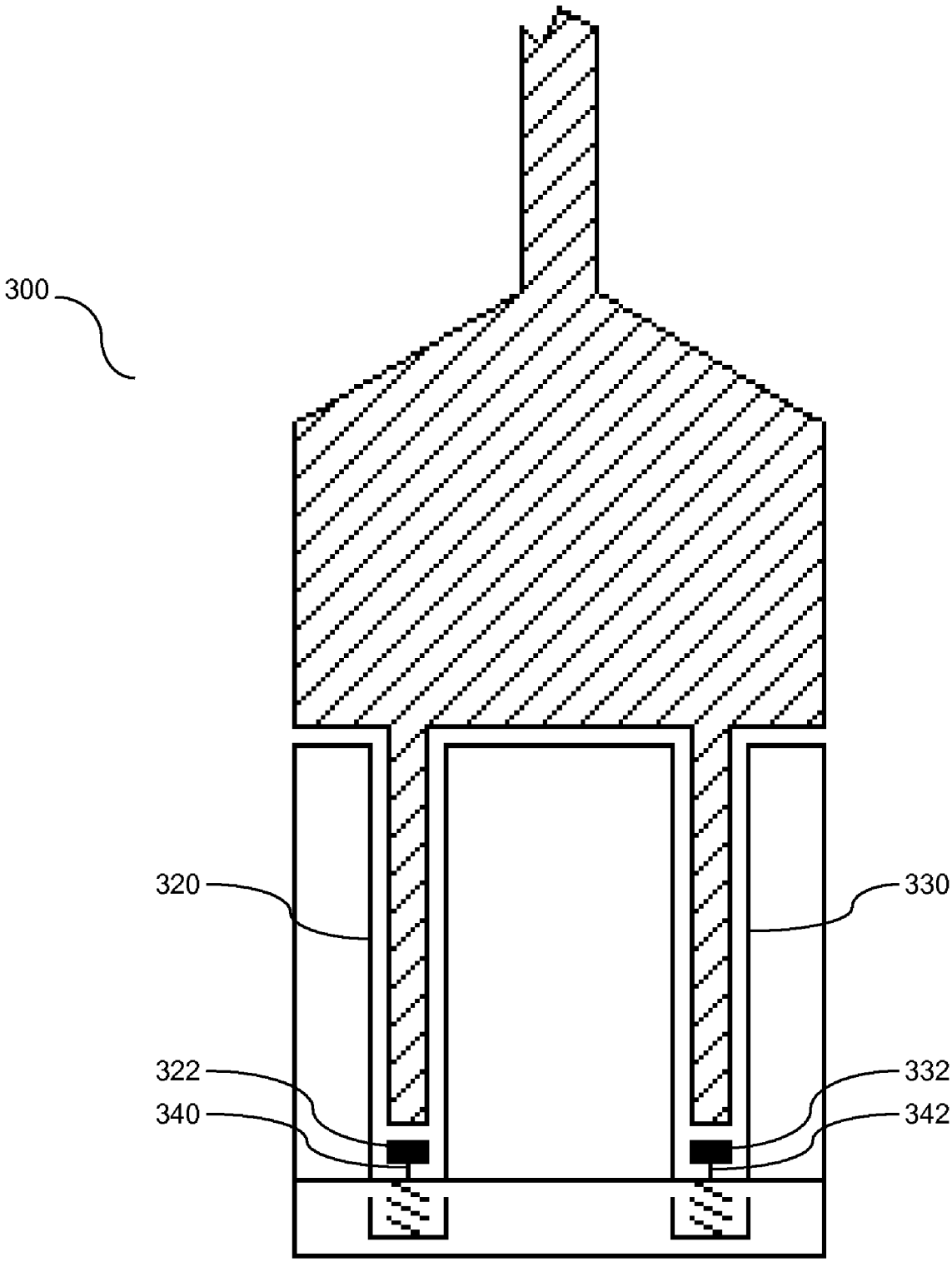
FIG. 3 is a block diagram of a modified electrical outlet with a set of contact members and a timing element.

The physical embodiments of FIGS. 1 and 2, illustrate one form of detecting presence of a plug in an outlet, and controlling delivery of power to the outlet in response to detection of the plug. The outlet contact members of each of the embodiments may be modified to be in communication with a timing element. More specifically, the contact member arrangements remain, and a timing element is provided as an additional element. FIG. 3 is a diagram (300) of an outlet (310) with a plurality of contact members and a timing element. The outlet (310) is provided with two sockets (320) and (330), with each of the sockets configured to receive a connector member of a plug. As shown, socket (320) has a first member (322) and socket (330) has a first member (332). In addition, a second member (340) is provided in communication with socket (320) and a second member (342) is provided in communication with socket (330). In one embodiment, each of the second members (340) and (342) is connected to each of the first members (322) and (332), respectively. Similarly, in one embodiment, the communication of the second members (340) and (342) with the respective first members (322) and (332) may be a mechanical connection, an electronic connection, or a connection embedded in a computer readable carrier in the form of computer instructions. As in FIGS. 1 and 2, the first members (322) and (332) detect the physical presence of a connector of a plug in the respective socket. The second members (340) and (342) function in conjunction with the respective first members (322) and (332) to determine if the connector inserted into the outlet is a connector of an electrical apparatus. Each electrical operating device requires at least two connectors of a plug to be inserted into an outlet. The second members (340) insure that at least two connectors are received by the respective contact members within a threshold time period. The first member is an embodiment to ensure that the elements received in the respective sockets are from a single plug, and focus to differentiate the received connectors from non-plug related matter. Accordingly, the outlet includes a physical modification to insure insertion of an electrical appliance into the electrical outlet.

As shown in FIGS. 1-3, the physical outlet is configured with a contact member and/or an associated timing element as members of an authentication system for determining insertion of a plug of a valid electrical appliance. The outlet may operate in at least one of five states of operation. Each state provides granular control of power delivery to the outlet and safety from unauthorized use of the outlet. The five states of operation include: off and unlocked, on and insecure, off and locked, on and secure, and off and locked after timeout. Each of the states employs different aspects of safety and security associated with use of the outlet. In one embodiment, a control mechanism is in communication with the outlet to maintain the outlet in one of the five states of operation, or to modify the state of operation of the outlet. The control mechanism communicates one of five key events to the outlet to place the outlet into one of the five states of operation. Examples of the key events include: lock, unlock, timed unlock, enable security, and disable security. In one embodiment, the control mechanism communicates with the outlet through physical contact. However, the invention should not be limited to this physical contact. For example, in one embodiment, the control mechanism may communicate with the outlet through a wireless radio frequency signal, an optical signal, etc. Similarly, in one embodiment, the communication mechanism may include an addressing control unit for selecting specific outlets with which to communicate a change of state. A state diagram showing each of the state and transitions among the state is shown in detail in FIG. 8. Accordingly, the key events of the control mechanism function to place the outlet into a corresponding state of operation.

Figure 4:
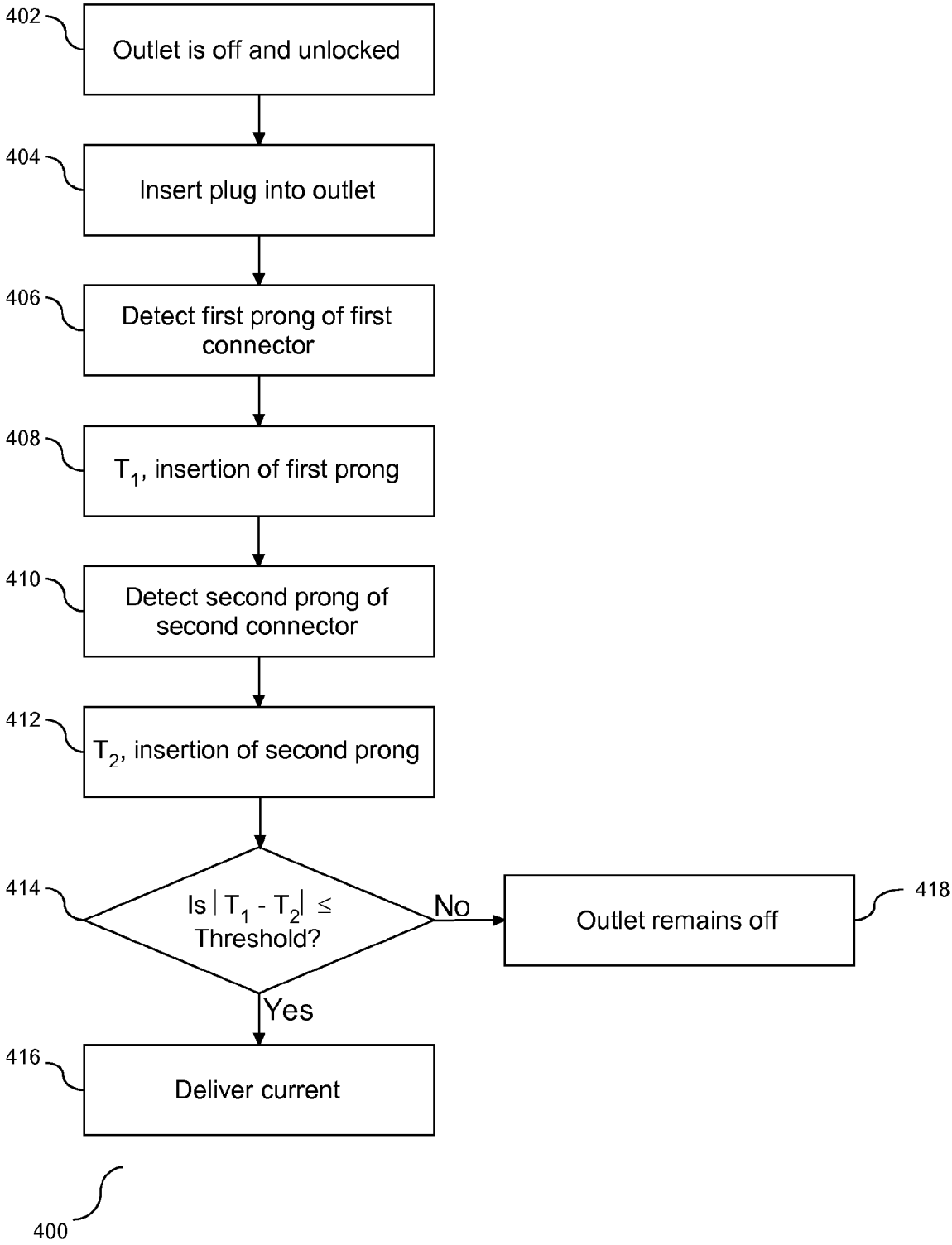
FIG. 4 is a flow chart illustrating authentication of an appliance by the modified electrical outlet.

FIG. 4 is a flow chart (400) demonstrating one embodiment for authenticating insertion of an appliance with at least two connectors on an associated plug. Initially, the outlet is in an off and unlocked state (402). A plug is inserted into the outlet (404) with a first contact of a first socket detecting insertion of a first connector (406). The timing element associated with the first contact sets the time of insertion of the first prong as $T_1$ (408). Similarly, a second contact of a second socket detects insertion of a second connector (410). The timing element associated with the second contact sets the time of insertion of the second prong as $T_2$ (412). Based upon a reading at steps (408) and (412), it is determined if the time differential between the detection of the two connectors is within a defined threshold (414). The purpose of the determination at step (414) is to detect insertion of a plug and to differentiate it from insertion of another object into the female receptacle of the outlet. It is known in the art that inappropriate objects periodically get inserted into electrical outlets. If at step (414) it is determined that the two connectors were in communication with the respective contacts within a defined time period, then the outlet is turned on and current is delivered to the associated electrical appliance (416). Conversely, if at step (414) it is determined that the two connectors were not in communication with the respective contacts within the defined time period, then the outlet remains off (418). Accordingly, the contacts in conjunction with a timing element authenticate receipt of a valid plug for an electrical appliance.

The authentication system demonstrated in FIG. 4 functions for the outlet when it is operating in a first defined state, also known as an off and unlocked state. When a valid plug is recognized, power to the outlet is turned on. Conversely, when it is determined that the plug is not valid, power to the outlet remains off. The authentication system prevents injuries associated with insertion of inappropriate items into the outlet, including items such as papers clips, knifes, toys, kitchen utensils, etc.

As explained above, the outlet functionality demonstrated in FIG. 4, is one of five states of operation of the outlet. The state of the outlet may be changed, with a changed state reflecting different characteristics. More specifically, when the outlet is in the off and unlocked state, insertion of a valid plug will change the state of the outlet to an on and unlocked state. This state change is a local change caused by insertion of a valid plug into the outlet operating in an off and unlocked state. Similarly, the state of the outlet may experience a local change from on and unlocked state to off and unlocked by removal of the plug from the outlet. Accordingly, the state of the outlet may locally toggle between the off and unlocked state and the on and unlocked state through insertion and validation of a plug into the outlet, and removal of the plug from the outlet, respectively.

An outlet may be placed in an off state from an on state. More specifically, there are three off states that are available for the outlet. One off state is an off and unlocked state. This state may be entered from the on and unlocked state by merely removing a plug from the outlet. Another state is known as an off and locked state. This state may only be entered with use of an external control mechanism. Accordingly, to enter a locked state, an external mechanism is employed to communicate with the outlet.

Figure 5:
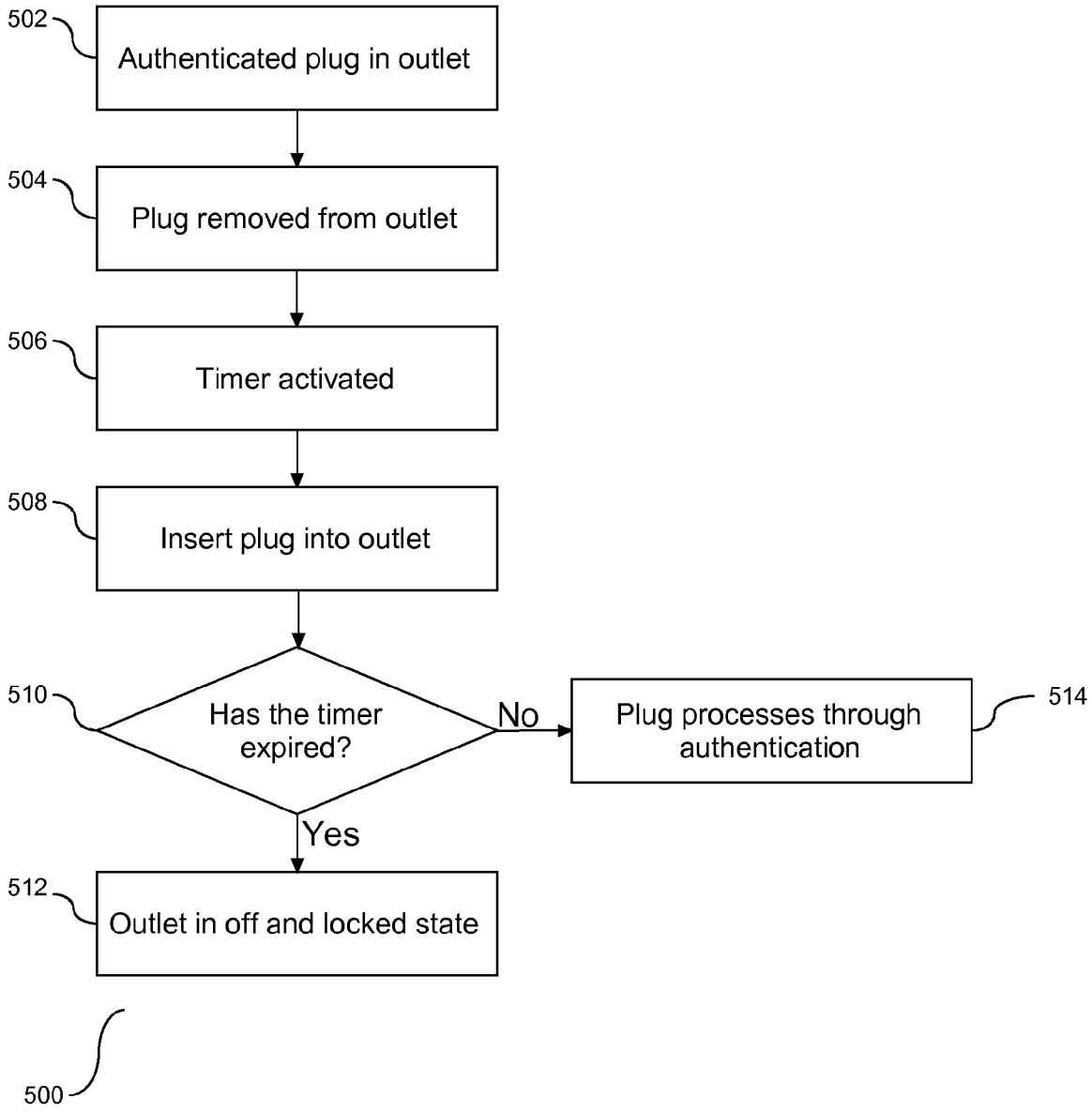
FIG. 5 is a flow chart illustrating employing a timer for placing the outlet in a locked state.

Each of the states described above are known as persistent states in that the state of the outlet is relatively static and does not fluctuate with respect to time. In one embodiment, the state of the outlet is stored in non-volatile memory so that in the case of a power failure, the outlet can return to the correct state when power is restored. However, the outlet may also operate in a transient state through use of a timer mechanism. The timer mechanism is an added feature that enables the outlet to automatically lock the delivery of power after expiration of the time interval. FIG. 5 is a flow chart (500) demonstrating one embodiment for employing a timer to lock the outlet. Initially, an authenticated plug is in the outlet (502). Following removal of the plug from the outlet (504), a timer is activated (506). Shortly thereafter, the same plug or a different plug is inserted into the outlet (508). Prior to authenticating the plug, it is determined if the timer has expired (510). A negative response to the determination at step (508) places the outlet into an "off" and locked state (512). In order for the plug to be authenticated, the outlet must be placed in an unlocked state. Conversely, a positive response to the determination at step (508), allows the plug to process through authentication (514). If the plug is authenticated, power will be delivered to the outlet as demonstrated in FIG. 4. The timer mechanism provides a time interval which locks the outlet after expiration of the interval unless a valid plug is inserted before the timer expires. Accordingly, as demonstrated, activation of a timer places the outlet in a transient state of operation.

Figure 6:
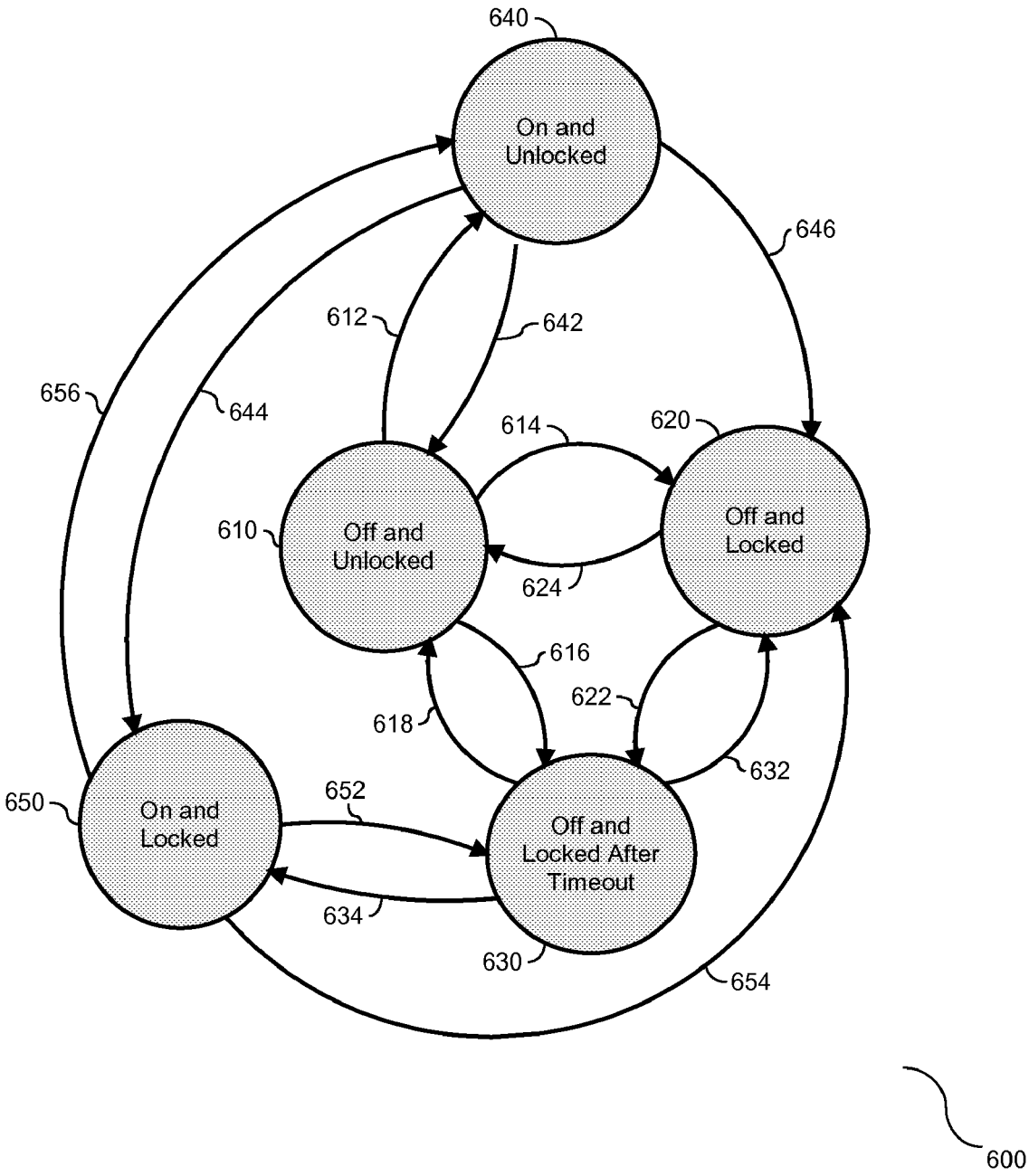
FIG. 6 is state diagram illustrating the different states of operation of the modified electrical outlet, including entry and exit among the states, according to the preferred embodiment of this invention, and is suggested for printing on the first page of the issued patent.

As described herein, the outlet may operate in one of five states to control delivery of power to a recipient plug. FIG. 6 is a state diagram (600) demonstrating the different states of operation, and entry and exit among the states. More specifically, as shown there are five states, each state separately represented. The states include, off and unlocked (610), off and locked (620), off and locked after timeout (630), on and unlocked (640), and on and locked (650). From the off and unlocked state (610), the outlet may transition (612) to the on and unlocked state (640), transition (614) to the off and locked state (620), or transition (616) to the off and locked after timeout state (630). Transition (612) from the off and unlocked state (610) to the on and unlocked state (640) is demonstrated in FIG. 4.

Figure 7:
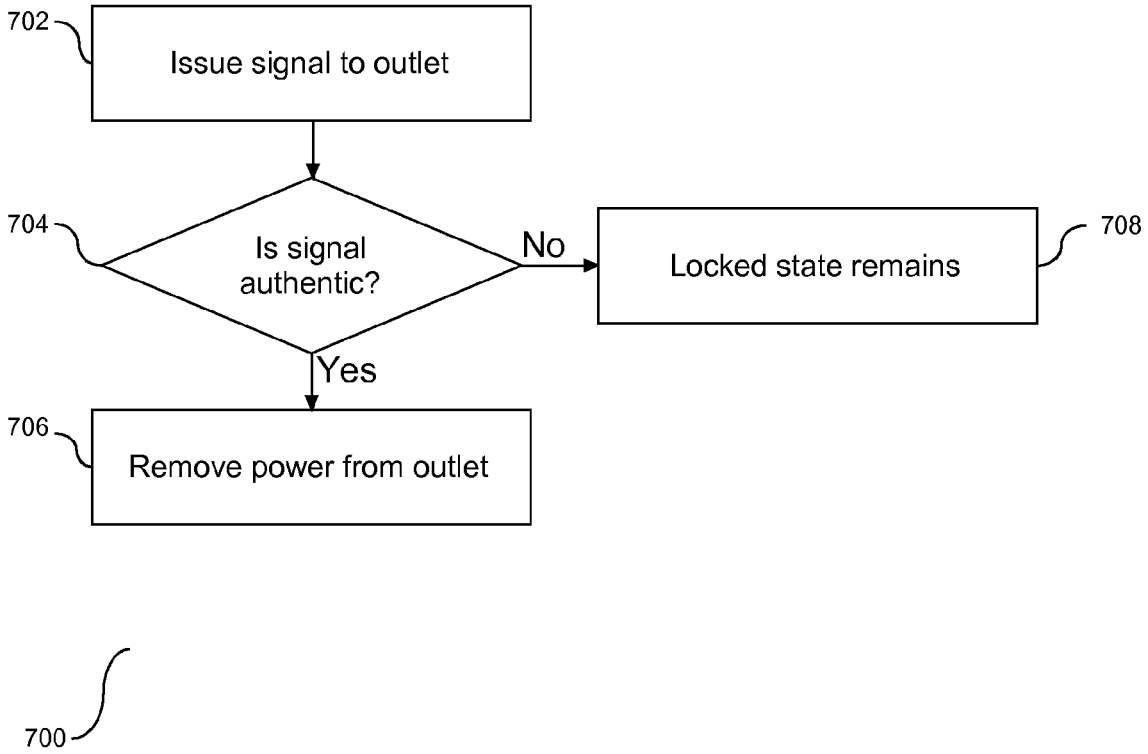
FIG. 7 is a flow chart illustrating transition of the outlet to the off and locked state.

In order to transition (614) to the off and locked state (620), a control mechanism is employed. Another aspect of transitioning (646) to the off and lock state (620) is from the on and unlocked state (640), where power for the outlet is initially provided. FIG. 7 is a flow chart (700) demonstrating transition to the off and locked state from the off and unlocked state. A signal is issued to the outlet (702), followed by a validation of the authenticity of the signal (704). In response to authentication of the signal, power is removed from the outlet (706). Conversely, if the signal is determined not to be valid, the unlocked state of the outlet remains (708). Accordingly, a transition (614) to the off and locked state (620) removes power from the outlet.

Figure 8:
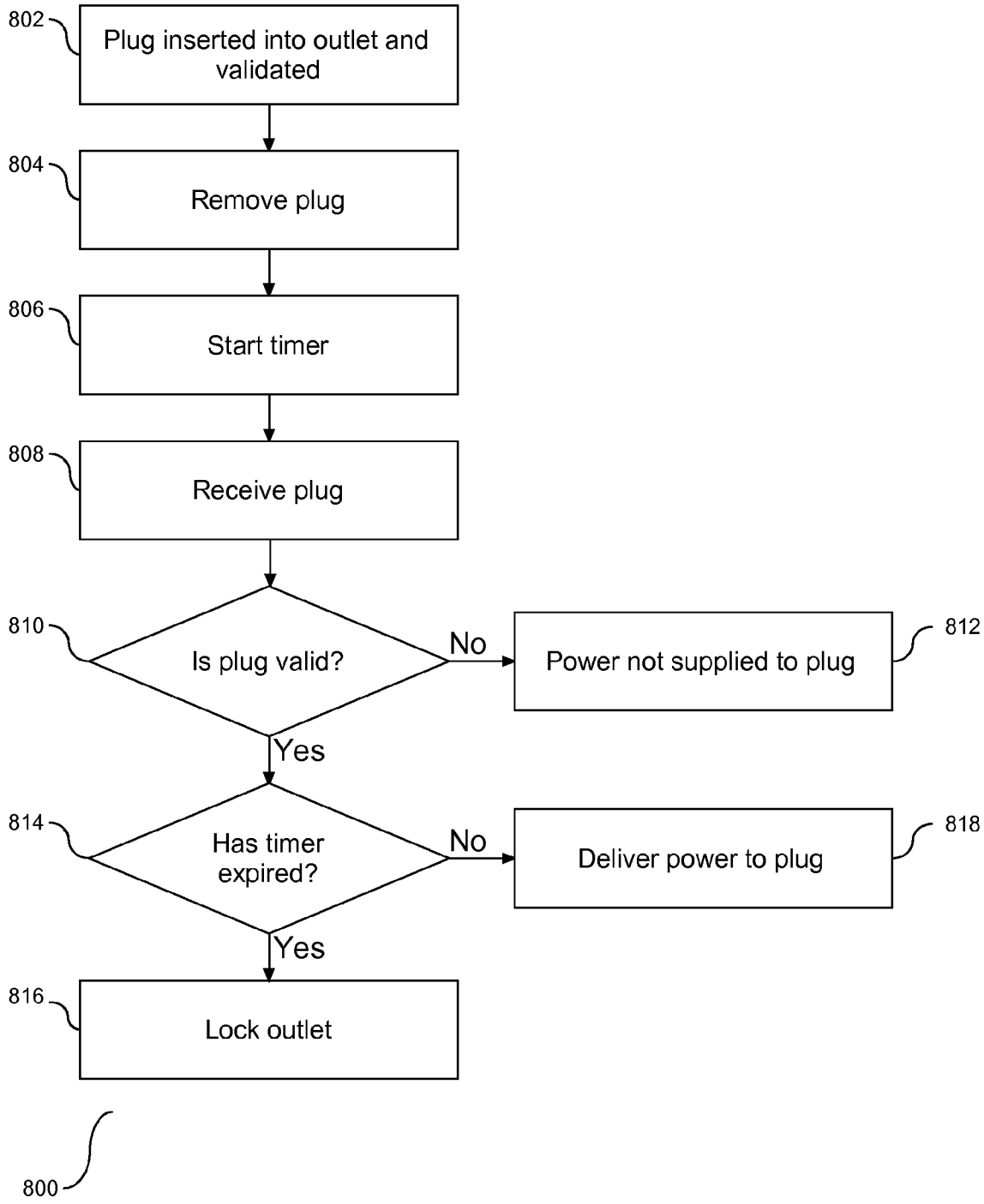
FIG. 8 is a flow chart illustrating employing a timer with the modified electrical outlet.

The outlet may transition (614) to the off and locked state (620) as demonstrated in FIG. 7, from the off and unlocked state (610) or transition (612) to the on and unlocked state (640). Transition (616) requires employment of a lock or lock mechanism to the outlet. In addition, the outlet may also transition (632) to the off and locked state (620) from the off and locked after timeout state (630). FIG. 8 is a flow chart (800) illustrating employment of a timer with the outlet. As shown, a plug has already been inserted into the outlet and validated (802). After the plug is removed from the outlet (804), a timer is started (806). The timer is employed to enable the outlet to remain available to receive the same plug or a different plug for a limited period of time. Following receipt of the same plug or a different plug by the outlet (808), it is determined if the received plug is a valid plug (810). See FIG. 4 for a further explanation of the authentication of a valid plug. If it is determined that the received plug is invalid, power is not supplied to the plug. Alternatively, if it is determined that the received plug is valid, it is then determined if the timer associated with the plug has expired (814). A positive response to the determination at step (814) is followed by a locking of the outlet (816) and power is not supplied to the plug. Conversely, a negative response to the determination at step (814) is followed by completing the circuit and delivering power to the received plug (818). Accordingly, the timer element enables the outlet to remain active from a prior active state for a limited period of time.

The outlet may enter the off and locked state after timeout (630) from one of three states, including (622) to the off and locked state (620), (618) to the off and unlocked state (610), and (652) to the on and locked state (650). From both (622) and (618) the off and locked state (620) and the off and unlocked state (610), respectively, an external control mechanism is employed to turn on the timer mechanism. However, the off and locked after timeout state (630) may be entered (652) from the on and locked state (650) by a mere removal of the plug from the outlet. If the outlet is in the on and locked state (650), it can only transition (654) to the off and locked state (620) or (656) to the on and unlocked state (640). A transition from the on and locked state (650) requires employment of an external control mechanism. In one embodiment, a different control mechanism or communication is employed for the two transitions (654), (656) from the on and locked state (650) to clearly define the state for transition. From the off and locked after timeout state (630), the outlets may transition (632) to off and locked (620) if the timer has expired, the transition (618) to the off and unlocked state (610) through a control mechanism, or (634) to the on and locked state (650). The outlet may also transition (642) from (640) to (610) by mere removal of the plug from the outlet, or transition (644) to (650) via a lock mechanism. Finally, the outlet may transition (624) from (620) to (610) via disabling of a previously enabled lock. Accordingly, transitions among some states are conducted by direct physical conduct pertaining to the plug and the outlet, while other transitions require employment of a control mechanism.

Figure 9:
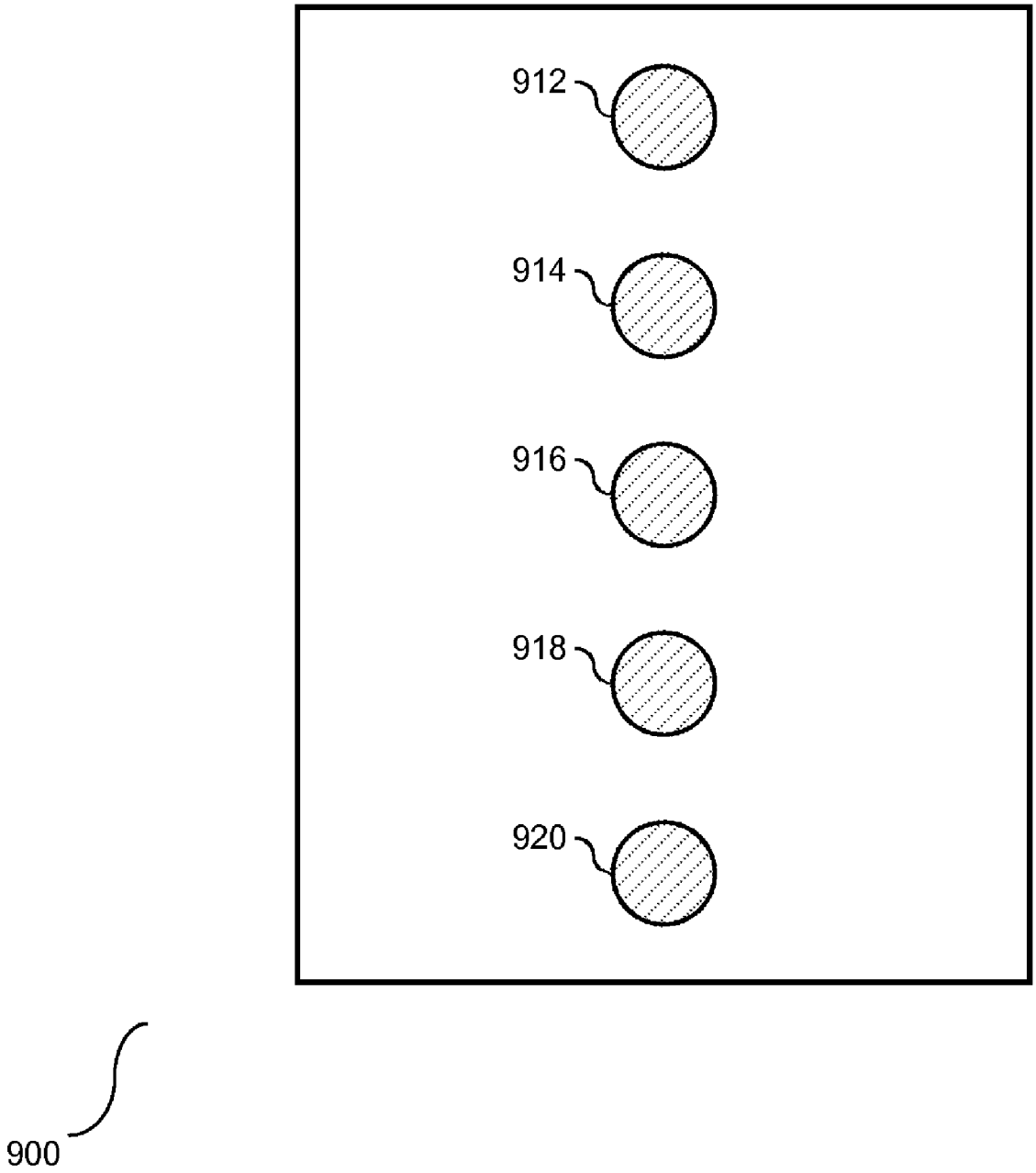
FIG. 9 is a block diagram of a configuration key to communicate with the modified electrical outlet.

As shown, the outlet may be in communication with an external mechanism to place the outlet into a locked state of operation. The external mechanism may come in the form of a key to communicate with the outlet to modify the state of operation of the outlet. FIG. 9 is a block diagram (900) of one configuration of a key (910). As shown, there are a series of controls present on the key, with each control pertaining to a control mechanism or release from one of the available states of operation. Each control is employed to communicate its respective state of operation to the outlet. More specifically, a first control (912) is employed to communicate a first state of operation to the outlet, a second control (914) is employed to communicate a second state of operation to the outlet, a third control (916) is employed to communicate a third state of operation to the outlet, a fourth control (918) is employed to communicate a fourth state of operation to the outlet, and a fifth control (920) is employed to communicate a fifth state of operation to the outlet. The controls (912)-(920) may be employed individually or in combination in order to change states. In one embodiment, there may be additional controls employed to address additional functionality of the outlet, or to enable a separate control for each available state of operation. The key (910) may communicate with the outlet through various mediums, including, but not limited to, radio frequency, optical, and physical contact with the outlet. In one embodiment, a single key (910) may be employed to communicate with a plurality of outlets, with each outlet having an identifying address and each key having an addressing control that supports selection of one or more outlets for communication. When the state of operation of an outlet is modified through use of the key, the address selection mechanism enables the key (920) to identify the outlet selected for modification. At such time as the identified outlet receives a communication from the key, the outlet enters the state of operation identified by the key.

In addition to the functionality for changing the state of the outlet, either remotely or locally, the outlet may be configured with a visual indicator (170), as shown in FIG. 1. In one embodiment, the visual indicator has a selection of available colors, with each color representative of a different state of operation of the outlet. Similarly, in another embodiment, the visual indicator is limited to a single color with visibility of a light representing an on state, removal of the light representing an off state, and a blinking of the light representing a transient state associated with the timer.

As noted above, a control mechanism may be employed to change the state of functionality of the outlet, which in effect changes the delivery of power to an authenticated plug. The outlet may include a programmable element to support the control mechanism, and to sustain or modify the state of operation of the outlet. The programmable element is in communication with the external control mechanism.

Embodiments within the scope of the present invention, including, but not limited to the programmable element of the outlet and the external control mechanism, also include articles of manufacture comprising program storage means having encoded therein program code pertaining to control of one or more outlets.

Advantages Over the Prior Art

The modified outlet provides varying states of operation, all of which control delivery of power to the outlet. More specifically, in contrast to a conventional electrical outlet, the modified outlet does not continuously deliver power from a power source. Rather, depending on the state of the outlet, power is delivered to the outlet following verification of a valid set of connectors. This prevents injuries associated with insertion of non-connectors into a socket. At the same time, power is not merely delivered to the outlet waiting for insertion of an authenticated set of connectors. Power is delivered to the outlet following verification and authentication of the connectors.

Alternative Embodiments

It will be appreciated that, although specific embodiments of the invention have been described herein for purposes of illustration, various modifications may be made without departing from the spirit and scope of the invention. In particular, in one embodiment the physical outlet may modified to include radio frequency identifier (RFID) tags and an associated RFID reader, or in communication with an RFID reader. Upon insertion of a plug into the outlet, an RFID reader would detect the presence of the RFID tags. Following a verification of the RFID tags, the outlet circuit is completed to enable the circuit to be completed and deliver power to the received plug. Accordingly, the scope of protection of this invention is limited only by the following claims and their equivalents.

We claim:

1. A method for controlling delivery of electrical power to a multi-mode electrical outlet, comprising:

providing an electrical outlet in communication with a power source, with a first contact associated with a first outlet socket and a second contact associated with a second outlet socket;

inserting at least two connectors of an electrical appliance into the outlet, with a first connector inserted into the first socket of the outlet and a second connector inserted into the second socket of the outlet;

employing a time detection element for authenticating insertion of each of the two connectors into each the separate sockets by the respective outlet contact within a defined timing threshold; and activating the electrical outlet in response to completion of the circuit within the defined timing threshold.

2. The method of claim 1, further comprising employing a radio frequency tag with the connectors, and reading the tags for verifying authorization of insertion of the connectors into the outlet.

3. The method of claim 1, further comprising modifying a state of delivery of power to the electrical outlet in response to removal of the electrical appliance from communication with the outlet.

4. The method of claim 1, further comprising changing the state of operation of the outlet by setting a state of delivery of power to the outlet.

5. The method of claim 4, further comprising modifying the state of operation of the electrical outlet, wherein the state of operation includes a state selected from the group consisting of: off and locked, off and unlocked, on and locked, on and unlocked, and off and locked after timeout.

6. The method of claim 4, further comprising employing a timer for transiting between states of operation, wherein expiration of the timer will lock the outlet.

7. The method of claim 1, further comprising positioning a visual indicator in communication with the electrical outlet for conveying identification of a state of the outlet.

8. An apparatus, comprising:

an electrical outlet in communication with a power source;

the outlet having a first contact associated with a first outlet socket and a second contact associated with a second outlet socket;

at least two connectors of an electrical appliance configured to be received by the outlet, with a first connector adapted to be inserted into the first socket of the outlet and a second connector adapted to be inserted into the second socket of the outlet;

a time detection element to authenticate insertion of each of the two connectors into each the separate sockets by the respective outlet contact within a defined timing threshold; and an activation of the electrical outlet in response to completion of the circuit within the defined timing threshold.

9. The apparatus of claim 8, further comprising a radio frequency tag in communication with the connectors, and a RFID reader to read the tags and verify authorization of insertion of the connectors into the outlet.

10. The apparatus of claim 8, further comprising a state of delivery of power to the electrical outlet modifiable in response to removal of the electrical appliance from communication with the outlet.

11. The apparatus of claim 8, further comprising a communication mechanism in communication with the outlet to change the state of operation of the outlet by setting a state of delivery of power to the outlet.

12. The apparatus of claim 11, further comprising modifying the state of operation of the electrical outlet, wherein the state of operation includes a state selected from the group consisting of: off and locked, off and unlocked, on and locked, on and unlocked, and off and locked after timeout.

13. The apparatus of claim 11, further comprising a timer employed to transition between states of operation, wherein expiration of the timer will lock the outlet.

14. The apparatus of claim 8, further comprising a visual indicator positioned in communication with the electrical outlet to convey identification of a state of the outlet.

15. The apparatus of claim 8, further comprising a computer readable carrier in communication with the outlet, including computer program instructions, configured to modify a state of operation of an electrical outlet.

16. The apparatus of claim 8, further comprising a visual indicator to communicate a state of operation of the outlet.

17. An electrical outlet, comprising:

a first contact associated with a first outlet socket and a second contact associated with a second outlet socket;

at least two connectors of an electrical appliance configured to be received by the outlet, with a first connector adapted to be inserted into the first socket of the outlet and a second connector adapted to be inserted into the second socket of the outlet;

a timer in communication with each of the sockets to authenticate insertion of each of the two connectors into each the separate sockets by the respective outlet contacts within a defined timing threshold;

activation of the electrical outlet in response to completion of the circuit within the defined timing threshold; and a control mechanism in communication with the outlet to modify a state of operation of the outlet.

18. The electrical outlet of claim 17, further comprising a transient state of operation that employs a timer to modify a state of operation irrespective of receipt of a connector in the socket.

19. The electrical outlet of claim 17, further comprising a position of operation, including an off position to prevent delivery of power to the outlet and an on position to support delivery of power to the outlet.

20. The electrical outlet of claim 19, further comprising a locked state of operation that holds the outlet in the position of operation.

* * * * *